US005307043A

United States Patent [19]

Dvorak et al.

[11] Patent Number: 5,307,043

[45] Date of Patent: Apr. 26, 1994

[54] TRANSFORMER ASSEMBLY WITH IMPROVED RETAINER AND INSULATOR

[75] Inventors: Robert F. Dvorak, Mt. Vernon; Charles E. Netolicky, Cedar Rapids, both of Iowa

[73] Assignee: Square D Company, Palatine, Ill.

[21] Appl. No.: 944,859

[22] Filed: Sep. 14, 1992

[51] Int. Cl.[5] ..... H01F 15/02

[52] U.S. Cl. ..... 336/174; 336/229; 336/198

[58] Field of Search ..... 336/174, 175, 198, 229

[56] References Cited

U.S. PATENT DOCUMENTS

| | | | |
|---|---|---|---|
| 2,920,297 | 1/1960 | Spicer | 336/174 |
| 3,921,113 | 11/1975 | Schiemann | 336/174 X |
| 4,054,856 | 10/1977 | Linscott, Jr. | 336/174 X |
| 4,571,569 | 2/1986 | Schart | 336/229 X |
| 4,623,865 | 11/1986 | Kiesel et al. | 336/229 X |
| 4,754,250 | 6/1988 | Duin | 336/229 X |
| 4,763,072 | 8/1988 | Katoh et al. | 336/229 X |
| 4,833,436 | 5/1989 | Martin et al. | 336/229 X |
| 4,868,532 | 9/1989 | Enrenhalt et al. | 336/229 X |
| 4,970,476 | 11/1990 | Ketagawa | 336/175 X |
| 4,972,169 | 11/1990 | Fujioka | 336/175 X |

FOREIGN PATENT DOCUMENTS

| | | | |
|---|---|---|---|
| 522633 | 9/1953 | Belgium | 336/174 |
| 580973 | 8/1959 | Canada | 336/174 |
| 66910 | 3/1990 | Japan | 336/229 |

*Primary Examiner*—Leo P. Picard
*Assistant Examiner*—L. Thomas
*Attorney, Agent, or Firm*—Larry I. Golden; Kareem M. Irfan

[57] ABSTRACT

For use in a trip unit, a transformer assembly is provided in a compact and cost effective form. The assembly includes a toroidal transformer between a pair of busses, and plastic retainers around a conductor which connects the busses. Each of the plastic retainers are molded as a plastic part which features: a flat portion separating the transformer axially from the adjacent bus, a tubular section attached to the flat portion which protrudes through the center of the transformer and serves to separate it radially from the bus, and a set of ribs protruding from the tubular, flat portions which serve to slightly penetrate the insulation material in the center of the transformer and grip the transformer to prevent it from rotating, and a lip protruding from the flat portion which causes the retainer to stop rotational motion relative to the bus.

18 Claims, 4 Drawing Sheets

TRANSFORMER ASSEMBLY WITH IMPROVED RETAINER AND INSULATOR

FIELD OF THE INVENTION

This invention relates generally to toroidal transformers and, more specifically, to toroidal transformers mounting assemblies for inducing current from power lines.

BACKGROUND OF THE INVENTION

Transformers are typically employed in electronic trip circuit breakers for current sensing and powering of an electronic trip unit. This is the case, for example, in the implementation described in U.S. Pat. No. 5,089,928, issuing on Feb. 18, 1992 to Durivage, III, et al. and entitled, "Processor Controlled Circuit Breaker Trip System Having Reliable Status Display."

Toroidal transformers are particularly attractive for this application, because they are not easily influenced by adjacent magnetic fields and they tend to have low excitation current compared to other constructions. However, toroidal transformers, due to their geometric shape, are unwieldy to secure in a sufficiently fixed position to protect them from shock and vibration caused by handling and shipping, and magnetic fields. Due to both mechanical and electromechanical forces, the transformer tends to move relative to its mounted position, and this exerts a stress on the lead wires emanating from the toroidal transformer. For instance, because of their shape, toroidal transformers tend to rotate due to vibration and general movement of the mounting structure. After sufficient rotation in one direction, the lead wires emanating from the transformer become the only structure which limits the rotation, and this can damage the lead wires. Furthermore, a current transformer normally needs supplementary insulation to provide sufficient dielectric strength between the bus and the secondary winding.

One method of overcoming these problems is to pot the transformer in a cup with a suitable potting compound, or to pot it directly without the benefit of a cup. The assembly may then be provided with means to secure it in position and the potting, or potting and cup, may provide supplementary insulation as well. The potting process, however, is relatively messy, costly and it increases the overall size of the assembly.

Toroidal transformers are also sometimes attached to printed wiring boards with a generally conical washer and a screw.

SUMMARY OF THE INVENTION

The present invention provides a compact and cost effective solution to these difficulties.

In a particular embodiment of the present invention, a transformer assembly includes a pair of opposing bracket-like busses, a toroidal transformer disposed between the opposing bracket-like busses and having an aperture therethrough and a plurality of leads, a conductor which connects the opposing bracket-like busses and which is located in the aperture of the toroidal transformer such that current is carried by the busses through the conductor and is induced by the toroidal transformer to the plurality of leads. Two insulators are located adjacent the opposing bracket-like busses and are situated such that the toroidal transformer is insulated from the opposing bracket-like busses. Further, at least one insulator includes an interfering section which abuts the toroidal transformer and protrudes into the aperture.

In another particular embodiment of the present invention, a molded insulator is designed to insulate a toroidal transformer from a conductor adjacent thereto. The insulator includes a substantially flat portion having a width adequately wide to provide insulative protection from the conductor, an interfering section emanating from the flat portion, and a plurality of ribs extending radially outwardly from the interfering section.

The ribs preferably protrude into the aperture of the toroidal transformer and around the conductor, so that the toroidal transformer is electrically insulated from the conductor. Moreover, the ribs are preferably designed to abut, and to follow, the inside surface of the toroidal transformer so as to retain the toroidal transformer and prevent it from rotating about the conductor. This alleviates undue stress on the leads of the transformer which would otherwise be present after slight movement or rotation of the toroidal transformer.

BRIEF DESCRIPTION OF THE DRAWINGS

Other objects and advantages of the invention will become apparent upon reading the following detailed description and upon reference to the drawings in which.

Figure 1:
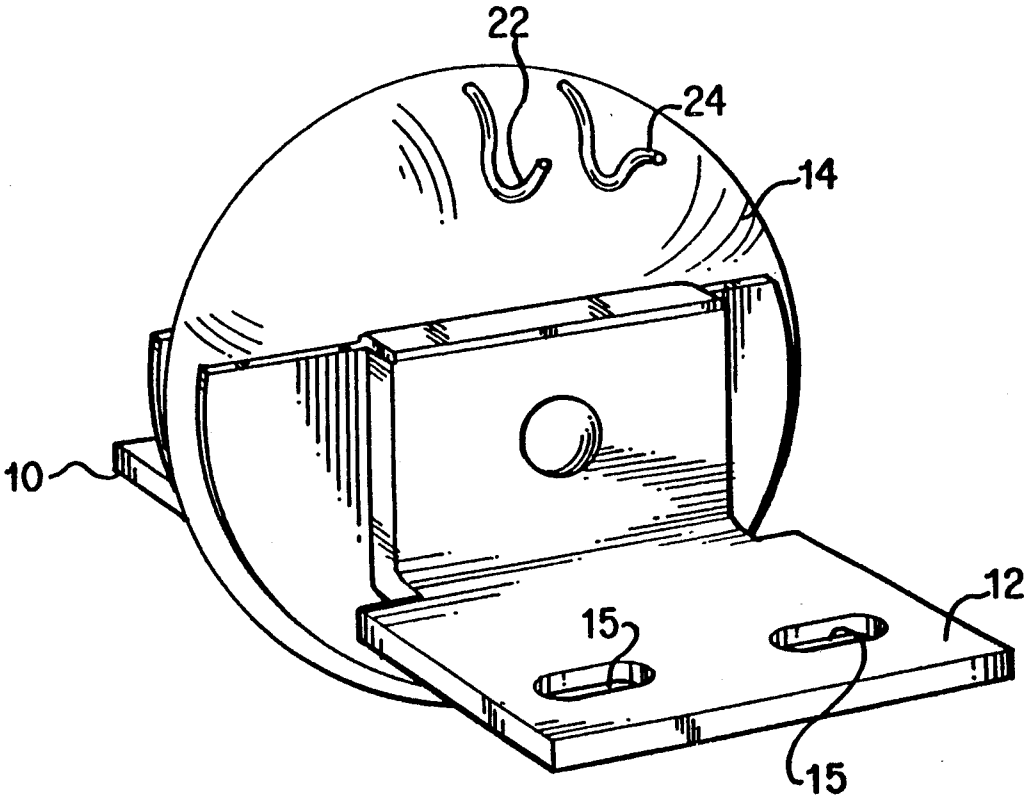
FIG. 1 is a perspective view of a toroidal transformer assembly, according to the present invention.

While the invention is susceptible to various modifications and alternative forms, specific embodiments thereof have been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
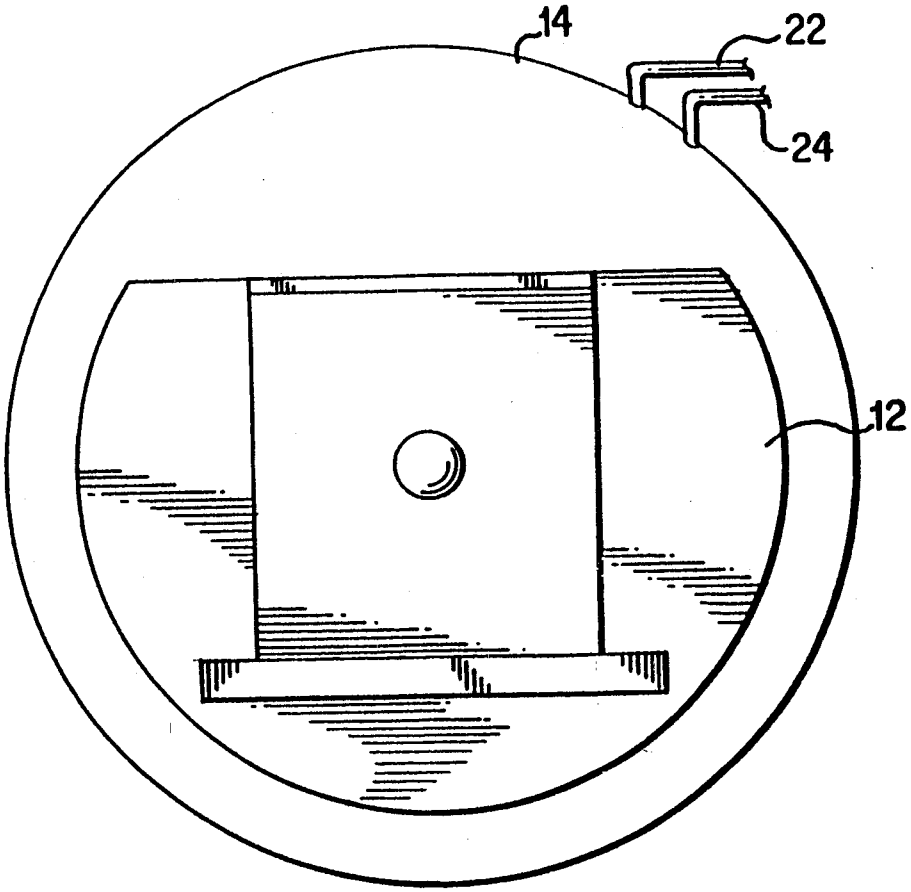
FIG. 2 is a side view of the assembly of FIG. 1.
Figure 3:
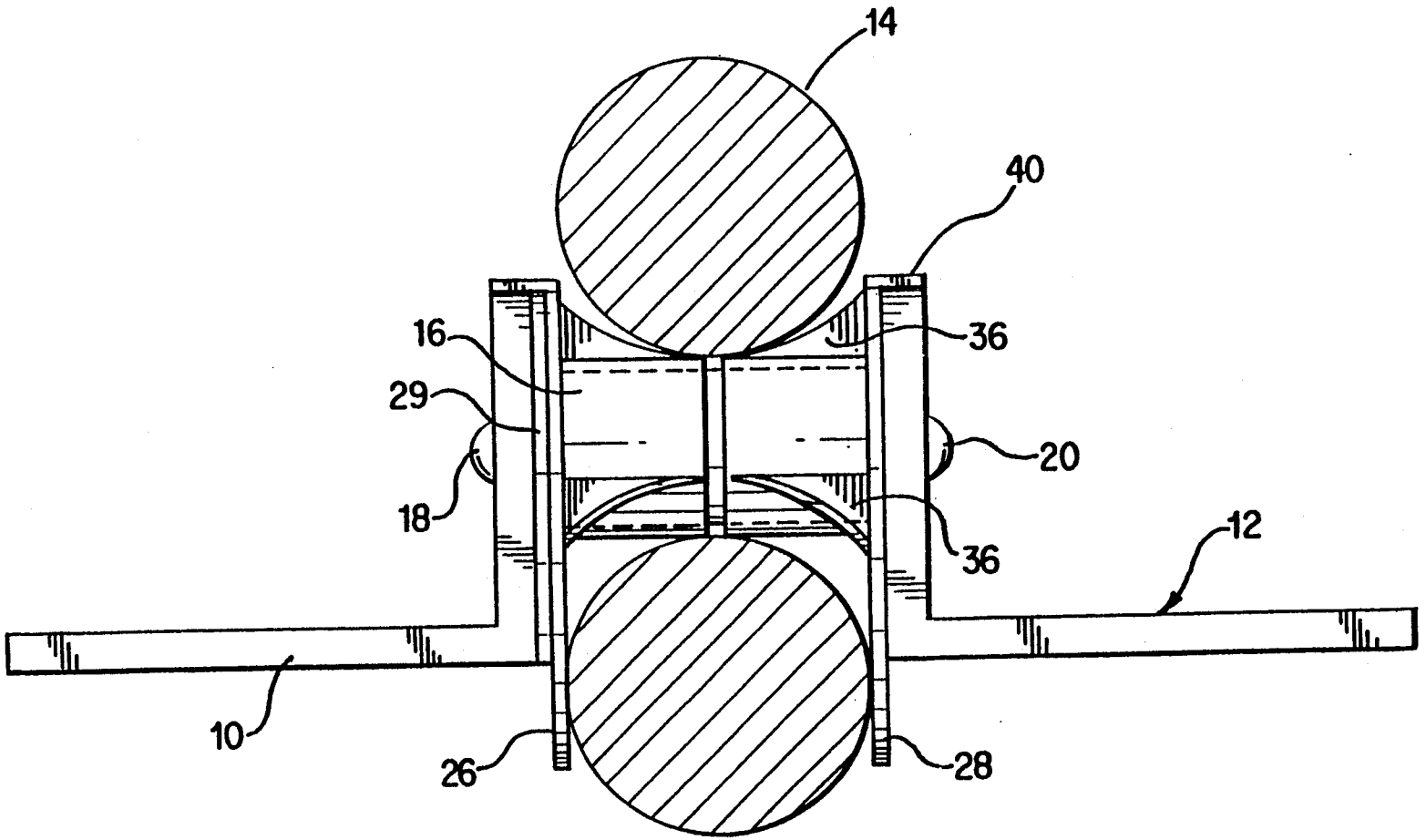
FIG. 3 is a cross-sectional view of the assembly of FIG. 1.
Figure 7:
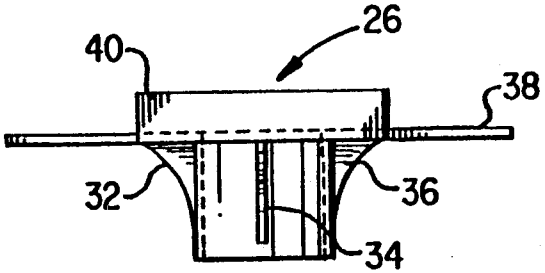
FIG. 7 is a top view of the insulative retainer of FIG. 4.
Figure 6:
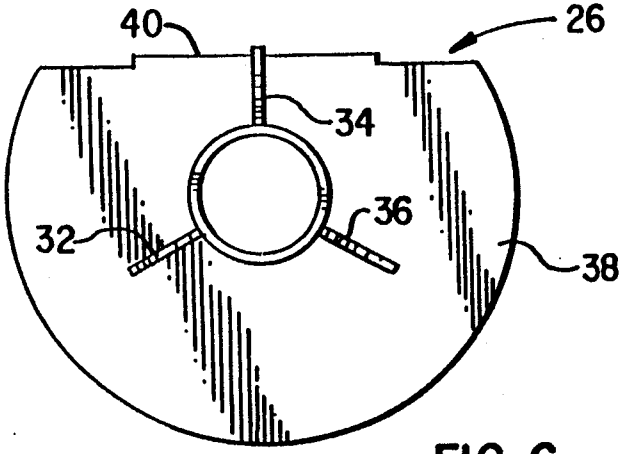
FIG. 6 is a front view of the insulative retainer of FIG. 4.
Figure 5:
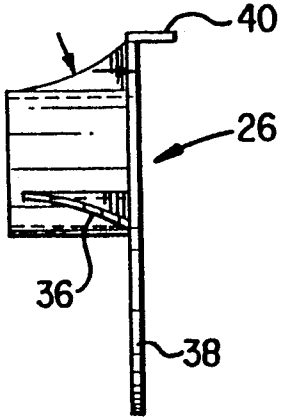
FIG. 5 is a side view of the insulative retainer of FIG. 4.
Figure 4:
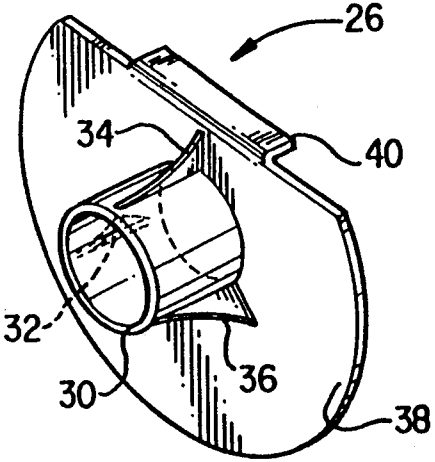
FIG. 4 is a perspective view of an insulative retainer, which is part of the assembly of FIG. 1 and is in accordance with the present invention.

Referring now to the drawings and particularly FIGS. 1–3, a toroidal transformer assembly is shown to include a pair of bracket-like busses 10, 12 on either side of a toroidal transformer 14. The busses 10, 12 are secured together by a cylindrically-shaped rigid conductor 16, which is riveted to the busses at ends 18, 20. The conductor 16 passes through the aperture at the center of the toroidal transformer 14.

In operation, the busses 10, 12 are mounted to secure the assembly in place, and the assembly is placed in series with a power line via bus holes 15 so that current passing through the conductor 16 is induced to the transformer and to its leads 22, 24.

Another important aspect of the present invention concerns the manner in which the toroidal transformer 14 is retained from moving or rotating about the conductor 16 and insulated from the busses 10, 12 and the conductor 16. The insulation and retainment functions are accomplished using a pair of molded one-piece retainers 26, 28, and a spring washer 29 which is placed directly over the conductor 16. The spring washer 29, which is available from Seastrom Mfg. Co. Inc. of Glendale, Calif., preferably goes over the conductor 16 and is interposed between the insulator 26 and the bracket-like bus 10.

These retainers, which are substantially identical, are shown in more detail in FIGS. 4–7. Each of the retainers 26, 28 includes a protruding section 30 with ribs 32, 34, 36 thereon, a flat section 38 and a lip 40 at the top of the flat section. The section 30 and the ribs 32, 34, 36 protrude into the aperture of the toroidal transformer 14 and around the conductor 16, so that the toroidal transformer 14 is electrically insulated from the conductor 16.

The ribs 32, 34, 36 are designed to abut, and to follow, the inside surface of the toroidal transformer 14 so as to retain the toroidal transformer 14 and prevent it from rotating about the conductor. This alleviates undue stress on the leads 22, 24 which would otherwise be present after slight movement or rotation of the toroidal transformer 14.

The ribs also serve to take up tolerance due to variations in the manufacturing process of the toroidal transformer 14.

The flat section 38 extends from the top of the adjacent bus 10, 12 to a point near the bottom of the toroidal transformer 14. Emanating from the top of the flat section 38 is a lip 40 which secures the insulator to an associated one of the busses 10, 12. A torque is exerted on this lip 40 in response to a rotational force on the toroidal transformer 14. Accordingly, that same rotational force is resisted by the top of the associated bus 10, 12, upon which the lip 40 rests.

While any of a number of different materials will suffice, the retainers 26, 28 can be manufactured using P1700 polysulfone, Celanex 2012 PBT polyester, or Zytel 103HSL nylon 6/6 type polymers, and the busses 10, 12 can be manufactured using copper.

The toroidal transformer 14 is conventional and is not considered as part of the present invention. However, a suitable toroidal transformer for implementing the assembly shown in the figures includes a 2021 turn transformer (for a 600 Amp circuit breaker), wrapped with a conventional insulative tape suitable (e.g., varnish impregnated tape) for UL requirements. This type of toroidal transformer is particularly useful in circuit breaker tripping applications, such as is described in previously referenced U.S. Pat. No. 5,089,928.

Accordingly, the present invention has been described in terms of an implementation which is compact and cost effective to manufacture and maintain. The retainers shown in the figures are manufactured as a molded plastic part which features: a flat portion separating the transformer axially from the adjacent bus, a tubular section attached to the flat portion which protrudes through the center of the transformer and serves to separate it radially from the bus, a set of ribs protruding from the tubular section, which serves to slightly penetrate the insulation material in the center of the transformer and grip the transformer to prevent it from rotating, and a lip protruding from the flat portion which causes the retainer to stop rotational motion of the retainer relative to the bus.

While the present invention has been described with reference to one or more particular embodiment, those skilled in the art will recognize that many changes may be made thereto without departing from the spirit and scope of the present invention. For example, certain modifications can be made to the design of the insulative retainers 26, 28 such that only one of the retainers would require ribs to prevent the toroidal transformer from moving or rotating. The following claims set forth the scope of the present invention.

We claim:

1. A transformer assembly, comprising:

a pair of opposing bracket-like busses;

a toroidal transformer disposed between the opposing bracket-like busses and having an aperture therethrough and a plurality of leads;

a conductor connecting the opposing bracket-like busses and at least partly located in the aperture of the toroidal transformer such that current is carried by the busses through the conductor and is induced by the toroidal transformer to the plurality of leads;

means for insulating the toroidal transformer from one of the opposing bracket-like busses; and an insulator located adjacent the other of said opposing bracket-like busses situated such that the toroidal transformer is insulated from said other of the opposing bracket-like busses, said insulator including an interfering section which abuts the toroidal transformer and protrudes into the aperture.

2. A transformer assembly, according to claim 1, wherein the interfering section is constructed and arranged to insulate the toroidal transformer from the conductor.

3. A transformer assembly, according to claim 1, wherein the interfering section is constructed and arranged to protect the toroidal transformer from rotating.

4. A transformer assembly, according to claim 1, wherein the interfering section is constructed with a plurality of ribs.

5. A transformer assembly, according to claim 1, wherein the insulator is a one-piece molded part.

6. A transformer assembly, according to claim 1, wherein the insulator includes means for securing the insulator to a respective one of the busses.

7. A transformer assembly, according to claim 6, wherein said other of the busses includes a flat edge structured and arranged to abut against said means for securing.

8. A transformer assembly, according to claim 1, wherein said insulator includes a substantially flat side section adjacent said toroidal transformer and a substantially flat mounting section supporting said flat side section and situated along a plane which is traverse to said flat side section.

9. A transformer assembly, according to claim 1, wherein said means for insulating the toroidal transformer from one of the opposing bracket-like busses includes another substantially identical insulator.

10. For insulating a toroidal transformer from a conductor adjacent thereto, a molded insulator comprising:

a substantially flat portion having a width adequately wide to provide insulative protection from the conductor;

an interfering section emanating from the flat portion; and a plurality of ribs extending radially outwardly from the interfering section.

11. A molded insulator, according to claim 10, wherein the interfering section is constructed and arranged to protect the toroidal transformer from rotating.

12. A molded insulator, according to claim 10, wherein the insulator is a one-piece molded part.

13. A molded insulator, according to claim 10, wherein the insulator includes means for securing the insulator to an adjacent bus.

14. A transformer assembly, comprising:

a pair of opposing bracket-like busses;

a toroidal transformer disposed between the opposing bracket-like busses and having an aperture therethrough and a plurality of leads;

a conductor connecting the opposing bracket-like busses and at least partly located in the aperture of the toroidal transformer such that current is carried by the busses through the conductor and is induced by the toroidal transformer to the plurality of leads;

means for insulating the toroidal transformer; and a pair of molded insulators located adjacent respective ones of said opposing bracket-like busses such that the toroidal transformer is insulated from said opposing bracket-like busses, each of said insulators including an interfering section which abuts the toroidal transformer and protrudes into the aperture to impede rotation of the toroidal transformer.

15. A transformer assembly, according claim 14, wherein each molded insulator includes a substantially flat portion having a width adequately wide to provide insulative protection from the conductor; an interfering section emanating from the flat portion; and a plurality of ribs extending radially outwardly from the interfering section.

16. A transformer assembly, according to claim 15, wherein each insulator is a one-piece molded part.

17. A transformer assembly, according to claim 14, wherein each insulator includes means for securing the insulator to the respectively adjacent bus.

18. A transformer assembly, according to claim 17, wherein said means for securing the insulator to the respectively adjacent bus includes a lip.

* * * * *